US009346664B2

(12) United States Patent
Krickeberg

(10) Patent No.: US 9,346,664 B2
(45) Date of Patent: May 24, 2016

(54) HORSE HALTER

(71) Applicant: Ahead of the Curve Holdings, Inc., Reddick, FL (US)

(72) Inventor: Kalley N. Krickeberg, Reddick, FL (US)

(73) Assignees: Ahead of the Curve Holdings, Inc., Reddick, FL (US); Kalley N. Krickeberg, Petaluma, CA (US)

( * ) Notice: Subject to any disclaimer, the term of this patent is extended or adjusted under 35 U.S.C. 154(b) by 92 days.

(21) Appl. No.: 14/184,338

(22) Filed: Feb. 19, 2014

(65) Prior Publication Data

US 2015/0068167 A1 Mar. 12, 2015

Related U.S. Application Data

(60) Provisional application No. 61/876,300, filed on Sep. 11, 2013.

(51) Int. Cl.
*B68B 1/02* (2006.01)

(52) U.S. Cl.
CPC ..... *B68B 1/02* (2013.01)

(58) Field of Classification Search
CPC ..... B68B 1/02; B68B 1/04; B68B 2001/042
See application file for complete search history.

(56) References Cited

U.S. PATENT DOCUMENTS

| | | | | | |
|---|---|---|---|---|---|
| 200,720 | A * | 2/1878 | Henkell | 54/24 | |
| 259,200 | A * | 6/1882 | Ostberg | 54/24 | |
| 299,354 | A * | 5/1884 | Covert | 54/85 | |
| 367,831 | A * | 8/1887 | Moss | 54/24 | |
| 856,415 | A * | 6/1907 | McClintock | 54/24 | |
| 923,369 | A * | 6/1909 | McClintock | 54/24 | |
| 1,278,021 | A * | 9/1918 | Robinson | B68B 1/02 54/24 | |
| 1,633,268 | A * | 6/1927 | Nelson et al. | 54/24 | |
| 1,746,403 | A * | 2/1930 | Mulcahy | 54/24 | |
| 2,961,816 | A * | 11/1960 | Reed | 54/24 | |
| 4,173,109 | A * | 11/1979 | Hibbert | 54/24 | |
| 4,180,963 | A | 1/1980 | Anderson | | |
| 4,337,610 | A * | 7/1982 | Taylor | 54/24 | |
| 4,459,795 | A * | 7/1984 | Le Tixerant | 54/6.2 | |
| 4,472,925 | A * | 9/1984 | Woodruff | B68B 1/02 54/24 | |
| 4,495,753 | A * | 1/1985 | Simpson | 54/24 | |
| 4,589,248 | A * | 5/1986 | Ruddock et al. | 54/24 | |
| 6,199,352 | B1 * | 3/2001 | Beaston | 54/24 | |
| 6,530,196 | B1 * | 3/2003 | Oyster | B68B 1/02 119/792 | |

(Continued)

FOREIGN PATENT DOCUMENTS

| | | | | |
|---|---|---|---|---|
| CA | 2334740 | * 12/1999 | | B68B 1/02 |
| DE | 202012102996 U1 | * 10/2012 | | B68B 1/02 |

(Continued)

*Primary Examiner* — Kathleen Alker
(74) *Attorney, Agent, or Firm* — Sand & Sebolt; Howard L. Wernow

(57) ABSTRACT

A horse halter has a combination of straps and ropes configured to provide comfort for the horse and control to the trainer. Halter includes a poll strap extending over the poll of the horse, a pair of cheek straps extending along the cheeks of the horse, a nose rope having knots extending over the bridge of the horses nose, a chin rope extending below the horse's chin, a throat rope and a snap member coupled together extending below the horse's throat, and a lower jaw rope extending forwardly from the throat rope having a slide ring fixed attached at a front end for slidably receiving the chin rope.

22 Claims, 6 Drawing Sheets

(56) References Cited

U.S. PATENT DOCUMENTS

| | | | | |
|---|---|---|---|---|
| 7,124,562 | B2 | 10/2006 | Blocker | |
| 8,429,884 | B2 * | 4/2013 | Roberts | 54/71 |
| 2005/0217220 | A1 * | 10/2005 | Blocker | 54/24 |
| 2008/0295465 | A1 * | 12/2008 | Kemp | 54/71 |
| 2009/0320418 | A1 * | 12/2009 | Gibbons | 54/24 |
| 2010/0071321 | A1 * | 3/2010 | Grant | 54/85 |
| 2011/0061348 | A1 * | 3/2011 | Sierra | 54/24 |
| 2011/0252751 | A1 * | 10/2011 | Nin | 54/24 |
| 2012/0311976 | A1 | 12/2012 | Voigt | |

FOREIGN PATENT DOCUMENTS

| | | | | |
|---|---|---|---|---|
| EP | 1117614 | | 6/1999 | |
| FR | 2878842 | A1 * | 6/2006 | B68B 1/02 |

* cited by examiner

HORSE HALTER

CROSS REFERENCE TO RELATED APPLICATION

This application claims priority from U.S. Provisional Patent Application Ser. No. 61/876,300, filed Sep. 11, 2013; the disclosure of which is incorporated herein by reference.

BACKGROUND OF THE INVENTION

1. Technical Field

The present invention relates generally to a device for controlling and training animals. More particularly, the present invention relates to an improved horse halter. Specifically, the present invention relates to a horse halter having a combination of flat straps and rope positioned to provide more comfort to the horse and greater control to the horse handler or trainer.

2. Background Information

Managing a horse involves communication between the horse and the human handler, trainer, owner or rider. Horses are able to learn and obey commands communicated by the handler. This learning process takes time and can be hindered or facilitated by the manner in which the handler or rider communicates with the horse. Horses have a tendency to resist or push into steady pressure when spread across a wide surface area, for example a harness collar for pulling heavy loads. For example, if a handler is signaling the horse to come to a stop by applying steady pressure, the horse may ignore the command or try to resist if it is applied with a thick, wide tool.

A great number of devices exist for performing this communication. These devices generally work by transferring some physical motion made by the handler or rider into a form of physical contact with the horse's body. Most horse-control devices are worn over a horse's head, partly because certain parts of a horse's head are particularly sensitive to contact, and the head is the best point of control for the whole animal.

Horse halters are devices placed on the heads of horses to guide and lead the horse. They are ordinarily made of a framework of leather or nylon webbing straps that lay flat against the skin surface to fit on the horse's head. This webbing-type head halter typically consists of a noseband running across the bridge of the nose and a poll strap (crown piece/headband), which runs down behind the ears and has a connected throat strap. The nose band is connected at opposite ends to respective cheek pieces, such as by means of metal hardware on nylon web halters. A lead line connected to the halter allows a handler to apply a forward, backward, left, right, and downward pressure to the horse's nose through the nose band, chin piece, cheek strap and poll strap.

Problems continue to exist with conventional webbing-type flat halters. Webbing halters are often constructed of wide nylon strap material around the nose and jaw (or jowl) of the horse. This wide material encourages the horse to lean or press against the wide strap when a command signal is given by the trainer via a lead line, rather than obeying the command signal.

Additionally, other types of halters exist. A rope halter is one that is primarily made from spun rope, or yacht rope, tied or fashioned together to lay around the horse's head. Rope halters have a nose rope that extends over the bridge of the horse's nose exerting pressure to the horse's nose when the lead line is pulled by the trainer.

Problems continue to exist with conventional rope halters. Rope halters lack handiness for the horse trainer and often cause a physically awkward dispersal of pressure on the horse's head when a control signal is given to the horse via the lead line. This is because the rope halter's simple construction and design allows the rope halter to shift relative to the horse's head and may be outside an effective pressure point range on the horse's head.

Therefore a need continues to exist for an improved halter device.

SUMMARY

In one aspect, the invention may provide a combination of a traditional nylon webbing halter and a conventional rope halter, wherein the poll and cheek straps lie flat against to horse's head for comfort, and the nose, chin, throat, and jaw straps are rope providing greater control for the horse trainer and provide a much clearer signal from the trainer to the horse.

In another aspect, the invention may provide the convenience, comfort, personalization, and functionality of a conventional flat webbing halter, such as stable buckles, rings, and snaps, with the control of a conventional rope halter. The invention may further provide a slide ring or connector for receiving a chin rope therethrough for providing additional signaling control by the horse trainer.

In another aspect, the invention may provide a horse halter comprising: a poll strap and a pair of cheek straps connected together and constructed of a material that lies flat against the surface of a horse's head; a nose rope, a chin rope, a throat rope, and a lower jaw rope connected together, and connected to the poll strap and pair of cheek straps via connectors, and constructed of rope; and a slide ring affixed to the forward end of the lower jaw rope for slidably receiving the chin rope.

Another embodiment of the invention may provide a horse halter comprising: a poll strap extending over a horse's poll; a pair of cheek straps connected to the poll strap via a left and a right side rear ring, each cheek strap extending along the horse's cheeks; a nose rope connected to the cheek straps via a left and right side forward ring, the nose rope extending over the bridge of the horse's nose; a flat halter snap attached to one of the left and right side rear ring; a throat rope connected to the flat halter snap and one of the left and right side rear ring not attached to the flat halter snap; a chin rope connected at each end to the left and right forward side rings, and the chin rope extending below the horse's chin; and a lower jaw rope extending between the chin rope and the flat snap, wherein the forward end of the lower jaw rope slidably receives the chin rope therethrough.

In yet another embodiment, one aspect may provide a horse halter comprising: an elongated flexible poll member including a flat horse engaging portion in cross section; an elongated flexible nose member including a convex horse engaging portion in cross section; and at least one flexible cheek member extending between the poll member and the nose member.

Additionally, one aspect may provide a horse halter comprising: a first flexible elongated member including a horse engaging linear portion in cross section; a second flexible elongated member including a horse engaging curved portion in cross section; and at least one flexible cheek member extending between the first member and the second member.

BRIEF DESCRIPTION OF THE SEVERAL VIEWS OF THE DRAWINGS

A sample embodiment of the invention, illustrative of the best mode in which Applicant contemplates applying the principles, is set forth in the following description, is shown in the drawings and is particularly and distinctly pointed out and set forth in the appended claims.

Similar numbers refer to similar parts throughout the drawings.

DETAILED DESCRIPTION

Figure 1A:
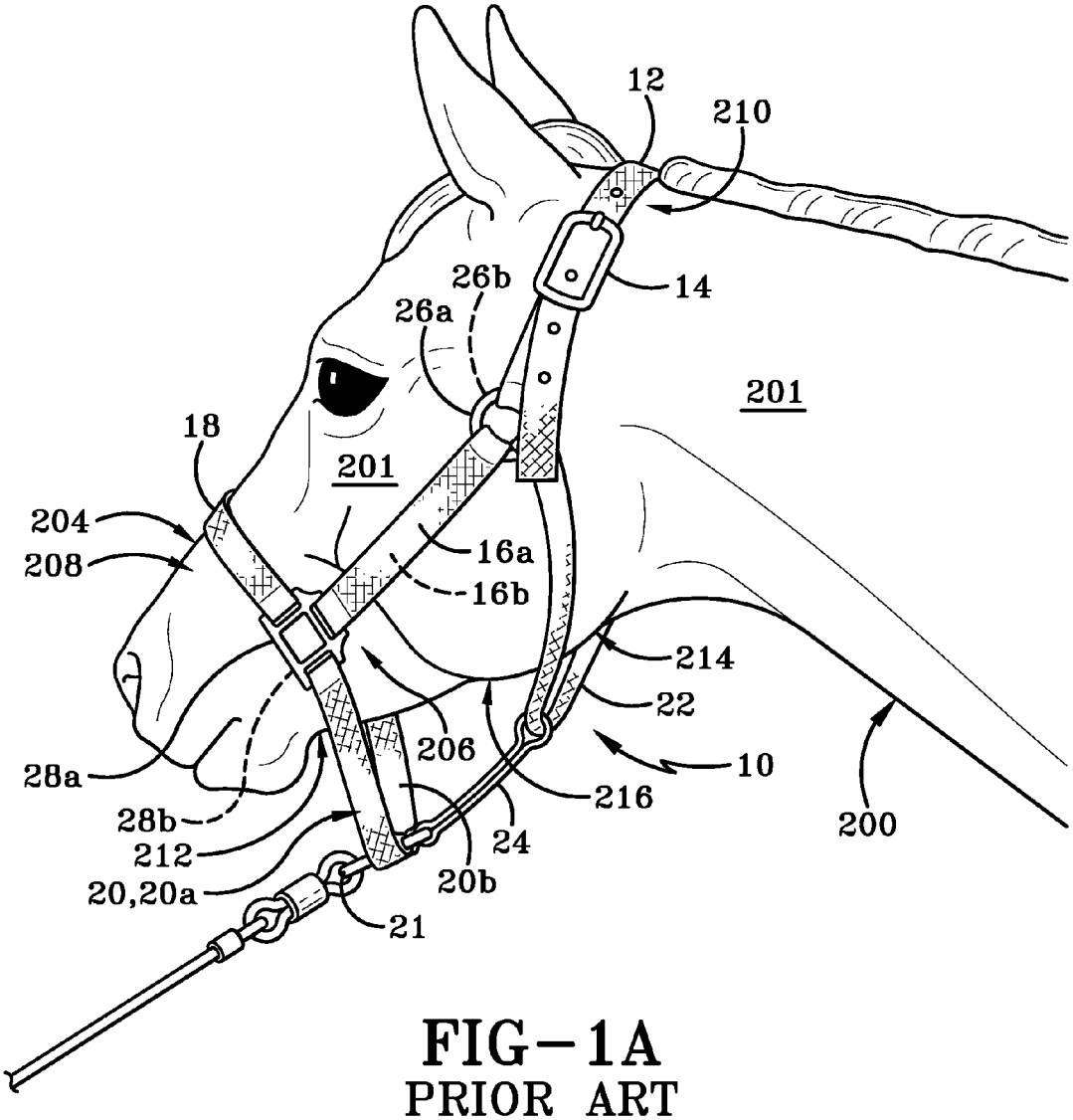
FIG–1A PRIOR ART
FIG. 1A is a perspective view of a known PRIOR ART strap halter mounted to the head of a horse.

FIG. 1A depicts a halter 10 known in the prior art that generally comprises a set of straps configured to fit securely on the head of a horse 200. Prior art halter 10 includes a poll strap 12 that extends around the horse's poll 210 and is adjustable via buckle 14, a pair of cheek straps 16*a*, 16*b* that extend along the horse's cheeks 206, a nose strap 18 that extends over the top of the horse's nose 208 and bridge 204, a chin strap 20 having first and second chin strap portions 20*a*, 20*b* respectively coupled together via ring 21 positioned adjacent and below the surface of the horse's chin 212, a throat strap 22 which extends around the horse's throatlatch 214, and a lower jaw strap 24 that extends along the bottom surface of the horse's lower jaw 216 from ring 21 to strap 22. Poll strap 12, cheek straps 16*a*, 16*b* and throat strap 22 are connected on each side of the horse's head by a pair of left and right rear side rings 26*a*, 26*b* respectively. Nose strap 18, cheek strap 16*a*, 16*b* and jaw straps 20*a*, 20*b* are respectively connected on the left and right side of horse's head by front connector 28*a*, 28*b* respectively. All of the straps 12, 16*a*, 16*b*, 20*a*, 20*b*, 22, 24 are constructed of nylon webbing that lays flat against the surface of the horse's head. A flat portion of web surface engages the horse's head.

Figure 1B:
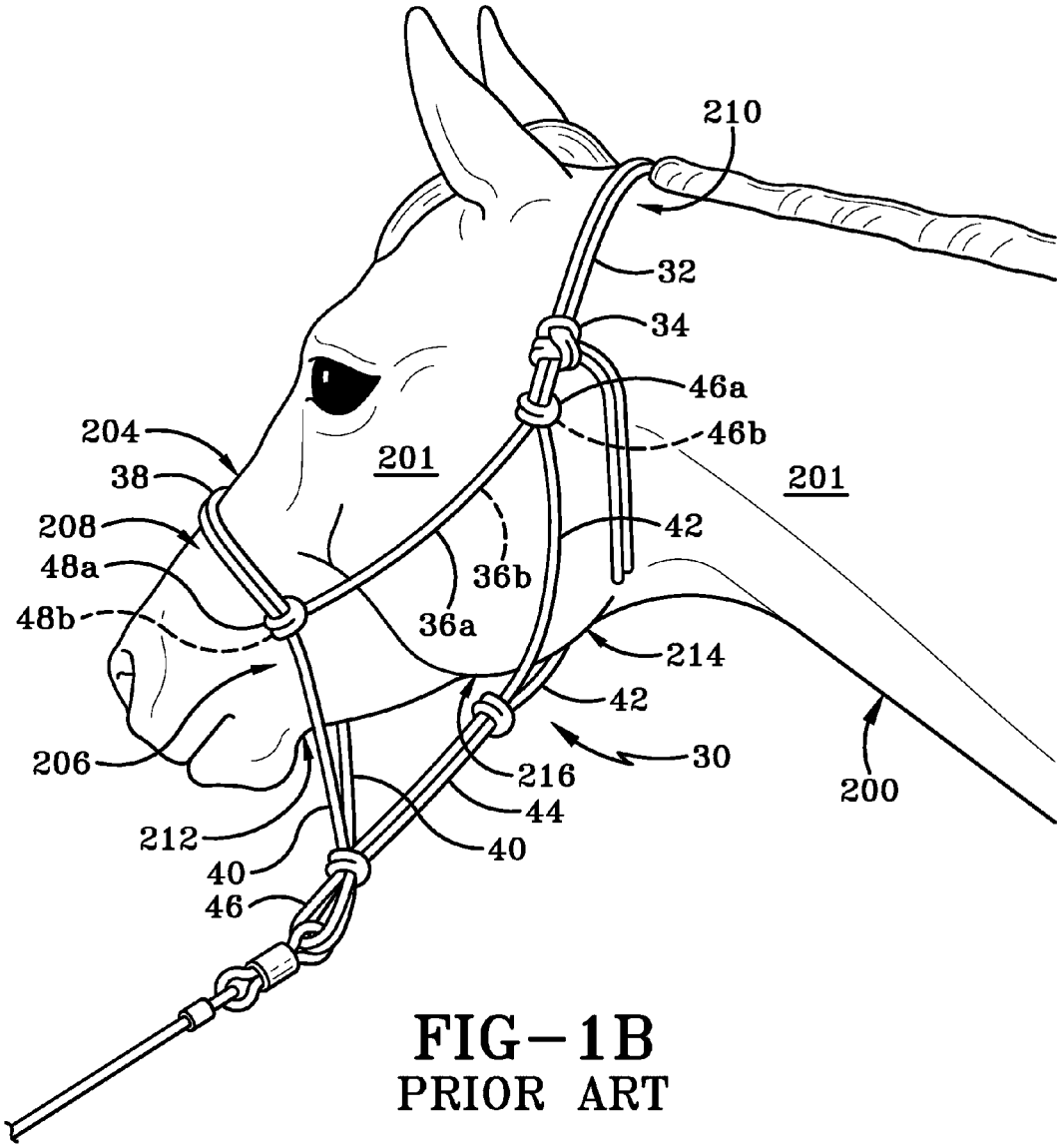
FIG–1B PRIOR ART
FIG. 1B is a perspective view of a known PRIOR ART rope halter mounted to the head of a horse.
Figure 2:
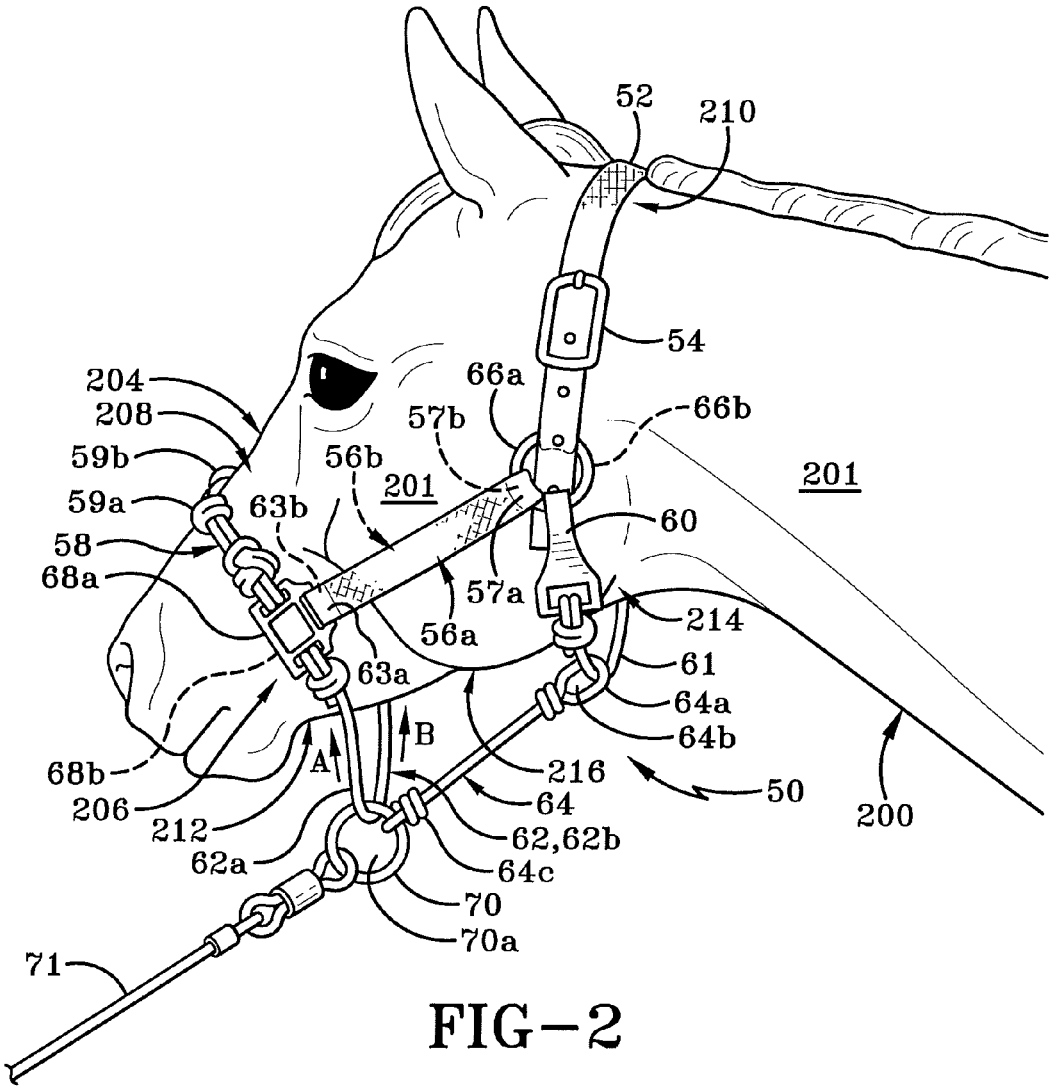
FIG. 2 is a perspective view of the present invention halter mounted to a horse.
Figure 3:
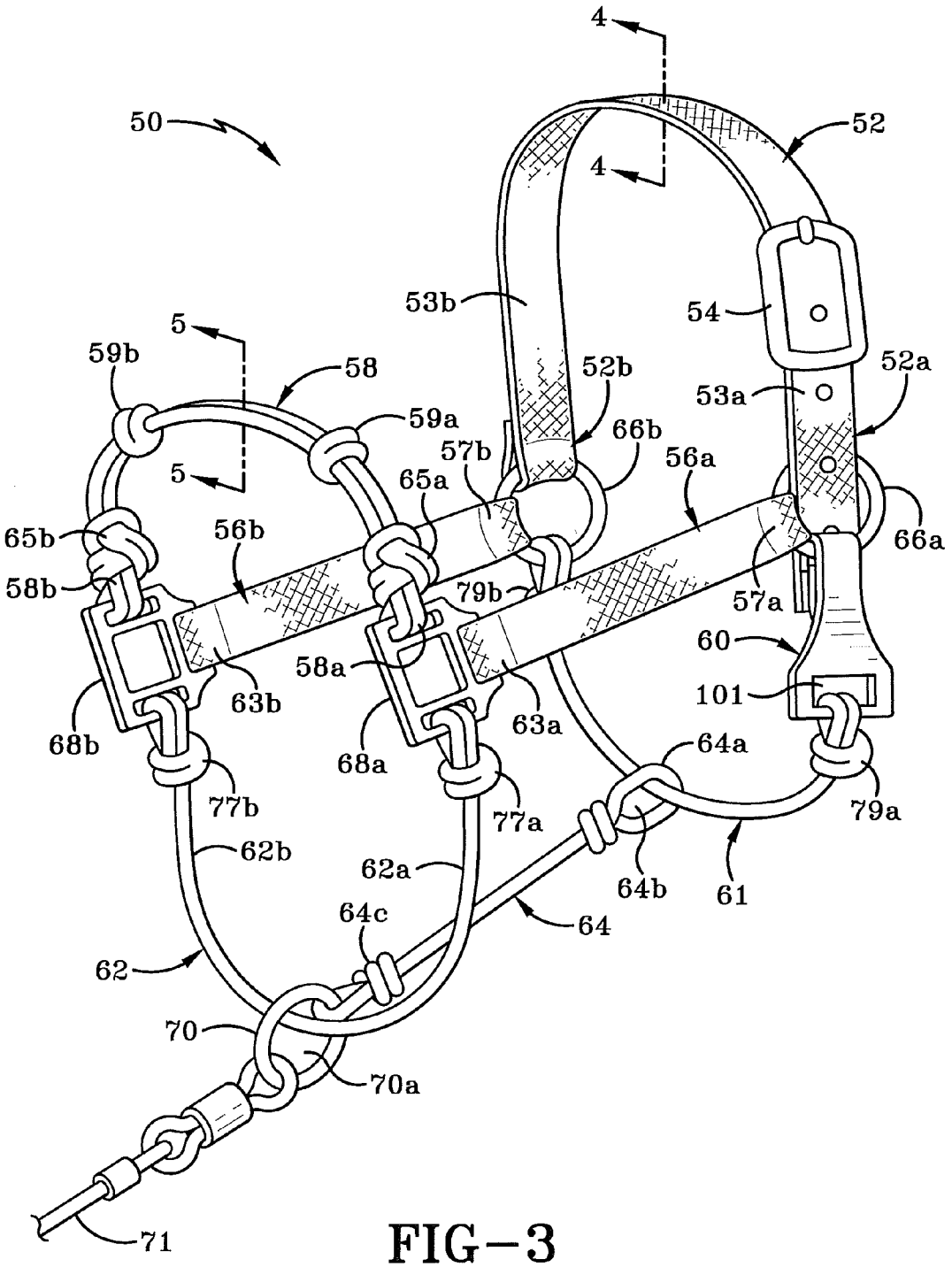
FIG. 3 is a perspective view of the present invention halter in a dismounted position, the halter including a poll strap and a pair of cheek straps, as well as a nose rope, a throat rope, a chin rope, and a lower jaw rope.

FIG. 1B depicts a prior art rope halter 30 including a poll rope 32 adjustable via a slidable knot 34 that extends around the horse's poll 210, a pair of cheek ropes 36*a* and 36*b* that extend along the horse's cheeks 206, a nose rope 38 that extends over the horse's nose 208 and bridge 204, a chin rope 40 that extends adjacent and below the surface of the horse's chin 212, a throat rope 42 that extends adjacent and below the surface of the horse's throatlatch 214, and a lower jaw rope 44 that extends adjacent and below the horse's lower jaw 216 between chin rope 40 and throat rope 42. Poll rope 32, throat rope 42 and chin ropes 36A, 36B are connected on each respective side of the horse's head by a knotted arrangement 46*a*, 46*b* respectively. Nose rope 38, chin rope 40 and chin ropes 36*a*, 36*b* are connected on each side of the horse's head by forward connecting knots 48*a*, 48*b* respectively. A looped connector 46 may be formed connected to chin rope 40 and lower jaw rope 44 to provide a connection point for a lead line. All ropes 32, 36*a*, 36*a*, 38, 40, 42 are constructed of rope having a circular cross section. A convex portion of rope surface engages the horse's head.

The halter of the present invention is shown in FIGS. 2-5 as 50. Halter. 50 includes a poll strap 52 adjustable via buckle 54 that extends around and over the horse's poll 210, a pair of left and right cheek straps 56*a*, 56*b* that extend along the horse's cheeks 206, a nose rope 58 that extends adjacent and over the horse's nose 208 and a bridge 204, a substantial rigid throat member or flat halter snap 60 that extends adjacent and below the left side surface of the horse's throatlatch 214, a throat rope 61 that extends adjacent and below the right side surface of the horse's throat latch and connects to flat halter snap 60, a chin rope 62 that extends adjacent and below the surface of the horse's muzzle or chin 212, and a lower jaw rope 64 that extends below the surface of the horse's lower jaw 216 between throat rope 61 and chin rope 62. Halter 50 further includes left and right rear side rings 66*a*, 66*b* positioned on opposite sides of the horse's head, left and right forward side rings 68*a*, 68*b* (also referred herein as forward side connectors) positioned on opposite sides of the horses head, and a bottom slide ring 70 slidably engaging chin rope 62.

Poll strap 52 is an elongated flexible member extending between a first end 52*a* and a second end 52*b*. Poll strap 52 may include a first segment and a second segment. First segment 53*a* of poll strap 52 may include a plurality of apertures formed in the first segment 53*a*. The apertures formed in the first segment 53*a* of poll strap 52 are configured to receive a tongue of buckle 54 therethrough. Buckle 54 is attached to second segment 53*b* of poll strap 52. First segment 53*a* may be thread through buckle 54 and is selectively adjustable by moving the tongue into a desired aperture to adjust the overall length of poll strap 52. Preferably first end 52*a* defines an end of first segment 53*a* and second end 52*b* defines one end of second segment 53*b* of poll strap 52. The ends 52*a*, 52*b* of poll strap 52 are coupled to left and right side rings 66*a*, 66*b* on opposite sides of the horse's head.

Figure 4:
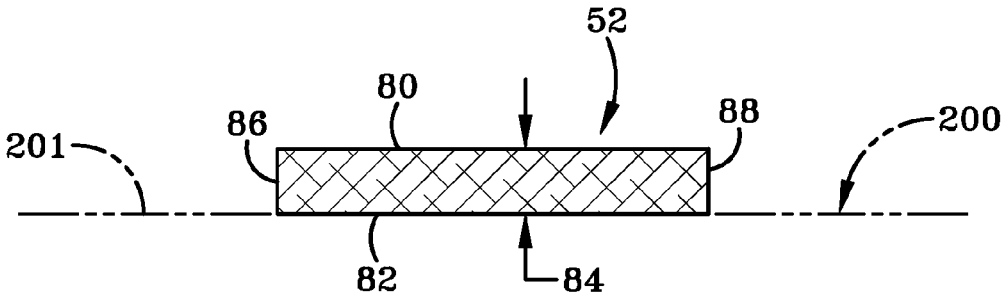
FIG. 4 is a cross-section view taken along line 4-4 of FIG. 3.

As shown in FIG. 4, poll strap 52 includes an outwardly facing top surface 80 and an inwardly facing inner surface 82. The term outwardly as used herein refers to the direction pointing away from the horse, and the term inwardly as used herein refers to the direction point towards the horse. Inner surface 82 is also known as the horse engaging surface. Strap 52 is preferably comprises an inner surface 82 that is flat or linear when viewed in cross section. The flat inner surface 82 of strap 52 lies against the horse skin surface 201. The flat inner surface 82 strap configuration 52 is important for the comfort of the horse.

Outer surface 80 is preferably parallel to flat horse engaging surface 82 therebetween forming a thickness 84. Thickness 84 defines the height of strap 52 left side wall 86 and right side wall 88. The thickness 84 height is less than the width of strap 52, wherein the width (also known as the first width, or width of strap) is measured from sidewall 86 to sidewall 88. Preferably the material comprising poll strap 52 is uniform across this cross section; however, clearly other non-uniform materials are contemplated. One exemplary uniform material is leather formed of a single hide and one exemplary non-uniform material may be a web of woven strap of nylon material. The woven nylon web material having a woven configuration which when viewed in a microscopic level may not be continuous.

Similar to poll strap 52, cheek straps 56*a*, 56*b* each include an outwardly facing top surface 80 and inwardly facing inner surface 82. Each inner surface 82 of cheek straps 56*a*, 56*b* is flat when viewed in cross section. The flat inner surface 82 of each cheek strap 56*a*, 56*b* lies against the skin 201 horse's cheek 206. Similar to the poll strap 52, the flat inner surface of cheek straps 56*a*, 56*b* is important to the comfort of the horse.

A forward end 63*a*, 63*b* of each cheek strap 56*a*, 56*b* is coupled to each respective left and right forward ring 68*a*, 68*b* on opposite sides of the horse's head. The ends of nose rope 58 are coupled to the left and right forward rings 68*a*, 68*b* allowing nose rope 58 to flexibly extend over the bridge of the horse's nose. The ends of chin rope 62 are coupled to left and right forward rings 68*a*, 68*b* allowing chin rope to arcuately extend below the horse's chin. The forward rings 68*a*, 68*b* can be formed with slots, or openings and dimensioned to receive the ends of cheek straps 56*a*, 56*b*, nose rope 58, and chin rope 62, respectively. Lower jaw rope 64 extends from throat rope 61 to chin rope 62 below the horse's jaw 216.

Snap 60 is coupled to left ring 66*a* and extends downward therefrom. One end of throat rope 61 is connected to snap 60 through a slot 101 formed therein and the other end of throat rope 61 is coupled to right ring 66*b*, permitting throat rope 61 to arcuately extend below the horse's throat 214. A rear end 57*a*, 57*b* of each cheek strap 56*a*, 56*b* is coupled to each respective rear ring 66*a*, 66*b* permitting the cheek straps 56*a*, 56*b* to extend forwardly along the side of the horse's cheeks 206.

Nose rope 58 is an elongated flexible member extending between a first end 58*a* and a second end 58*b*. Nose rope 58 is shown as a single member; however, it may be adjustable in a manner which would incorporate an adjustment buckle or end slide knots.

Nose rope 58 includes a left and right knot 59*a*, 59*b* formed along the length of rope 58. Knots 59*a*, 59*b* are disposed above the corner surface of the horse's nose where the nose bridge 204 meets the cheek 208. Knots 59*a*, 59*b* may be referred to herein as a bulb member(s). As shown in the figures, knots 59*a*, 59*b* may be tied using a single length of rope, i.e., the same length of material defining rope 58, or knots 59*a*, 59*b* may be tied to nose rope 58 from distinct and separate pieces of material. Further, while knots 59*a*, 59*b* are contemplated as being pieces of rope material, they could clearly be satisfactorily attached pieces or members configured to exert pressure to the skin surface of the horse's head, such as a bulbous clip, ball or clamp. Knots 59*a*, 59*b* have a cross section diameter greater than the cross section diameter of rope 58. Knots 59*a*, 59*b* may include multiple knots or raised braiding. Knots 59*a*, 59*b* are preferably stationary, and not-slidable, along nose rope 58.

Further, as depicted in the figures, nose rope 58 is shown as a single piece of rope material looped back through left and right forward ring 68*a*, 68*b* creating two rope segments extending over the nose bridge. Nose rope 58 is coupled to left and right forward side rings 68*a*, 68*b* at each respective end. Coupling the ends of nose rope 58 to left and right forward side rings 68*a*, 68*b* may be accomplished by tying knots 65*a*, 65*b* or sewing, however other coupling manners are clearly possible. When end knots 65*a*, 65*b* couple rope 58 to side rings 68*a*, 68*b*, there are then four knots positioned along rope 58. End knots 65*a*, 65*b* may be slidable along the length of nose rope 58.

Figure 5:
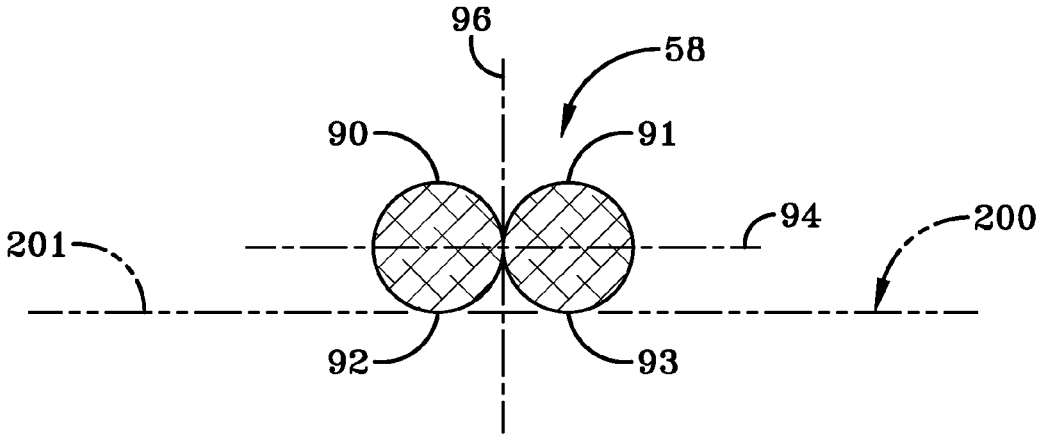
FIG. 5 is a cross-section view taken along line 5-5 of FIG. 3.

As shown in FIG. 5, when nose rope 58 is viewed in cross section, there is an upwardly facing convex surface 90 opposing a horse engaging and inwardly facing second convex surface 92. Outwardly facing convex surface 90 is delineated from horse engaging convex surface 92 by imaginary horizontal line 94. Horizontal line 94 approximately bifurcates the circular cross section of rope 58 into two semicircular halves. One embodiment of present invention 50 provides nose rope 58 being made of only a single rope strand, and in this instance rope 58 would only have outer surface 90 and horse engaging convex surface 92. In the shown embodiment of FIG. 5, an imaginary vertical line 96 splits the two double backed ropes of nose rope 58. Similar to surfaces 90 and 92, second strand segment of rope 58 has an outwardly facing convex surface 91 and a horse engaging inwardly facing convex surface 93. The two strands are split laterally by vertical line 96 and each strand is split vertically by horizontally extending imaginary line 94. When the embodiment shown in FIG. 5 is donned by the horse, horse engaging convex surfaces 92, 93 engage the skin 201 horse's nose 208 and bridge 204.

The width of rope 58 is equal to the rope's diameter. The width of the rope (also known as the second width; wherein the first width is measured from sidewall 86 to sidewall 88) is smaller or less than the first width. The first width of the poll member 52 substantially contacts the horse. Only a portion of the second width contacts the horse.

Chin rope 62 includes a left segment and a right segment 62*a*, 62*b* which make up the chin rope 62 respectively. Chin rope 62 is coupled to left and right forward side rings 68*a*, 68*b* at each respective end. Coupling the ends of chin rope 62 to left and right forward side rings 68*a*, 68*b* may be accomplished by tying knots or sewing, however other coupling manners are clearly possible. When chin rope 62 is coupled to rings 68*a*, 68*b* by tying knots 77*a*, 77*b*, the halter 50 has additional knots formed in rope different than nose rope 58. Further, rope 62 could include bulb members as well. Segments 62*a*, 62*b* are designated as representing the portions of chin rope 62 on each side of ring 70 that slidably receives rope 62 therethrough. Namely, segments 62*a*, 62*b* are continuous portions of a single rope 62. Ring 70 may slide up and to the left along segment 62*a* in the direction of Arrow A (FIG. 2), or may slide up and to the right along segment 62*b* in the direction of Arrow B (FIG. 2) when pulled via lead or training line 71.

Lower jaw rope 64 includes a looped rear end 64*a* forming an aperture 64*b* for slidably receiving throat rope 61 therethrough permitting rope 64 to slide up and to the right, and up and to the left along throat rope 61. Alternatively, jaw rope 64 could be fixedly attached to throat rope 61. When fixedly attached, jaw rope 54 and throat rope 61 may be one continuous piece of rope. Slide ring 70 is fixedly attached to the forward end 64*c* of jaw rope 64. Slide ring 70 slidably receives chin rope 62. Slide ring 70 forms an aperture 70*a* receiving rope 62 therethrough. Slide ring 70 is aligned sagittally with the horse's head.

Figure 7:
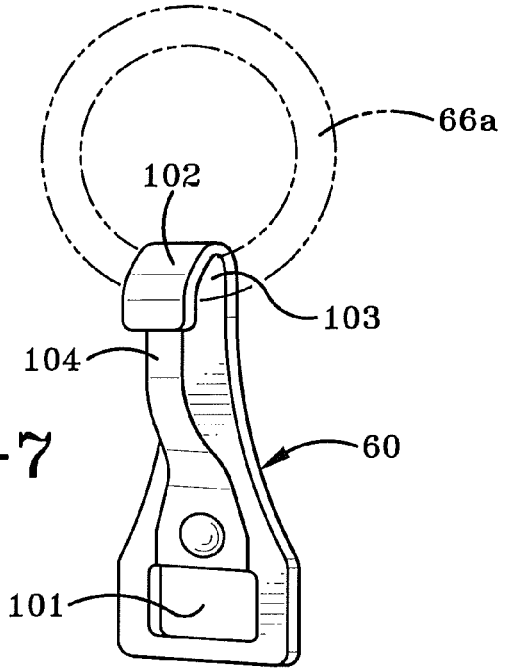
FIG. 7 is a perspective view of a rigid member or snap ring used with the halter of the present invention.

With reference to FIG. 7, rigid flat halter snap 60 is coupled to left ring 66*a* and extends generally downward therefrom adjacent and below the left side of horse's throat. In the shown embodiment, an upper end of halter snap 60 or any other type of snap is formed having a curve attachment member 102. Curved attachment member 102 is semi-circular when viewed from the side. Inner surface of curved attachment member 102 engages ring 66*a* permitting rigid member to connect and extend downward therefrom. A spring member 104 provides a snapping access to the ring retaining space 103 defined by the curved member 102 and spring 104.

When the snap halter snap 60 and ring 66*a* are attached, the curved member permits rigid member 60 to rotate relative to ring 66*a* without becoming disconnected. Rigid halter snap 60 further includes a retaining member or a slot formed 101 in the bottom end configured to receive and couple with an end of throat rope 61. An exemplary flat halter snap 60 is commercially available for sale under the name "Halter Snap Brass Plated" by Big Dees of Northfield, Ohio. Alternative embodiments to snap 60 are rings, dees, buckles, and clips, as understood in the art.

In accordance with one aspect of the invention as herein described above, halter 50 comprises straps 52, 56*a*, 56*b* and ropes 58, 61, 62, 64. Straps 52, 56*a*, 56*b* comprise a flat surface that is adjacent the horse's skin. The flat surface of straps provides comfort for the horse. Ropes 58, 61, 62, 64 have a rounded or convex surface and do not have a flat surface, that lays adjacent the horse's skin. The ropes provide greater control for the trainer when halter 50 is fitted to the horse's head and connected via lead line 71.

Figure 6:
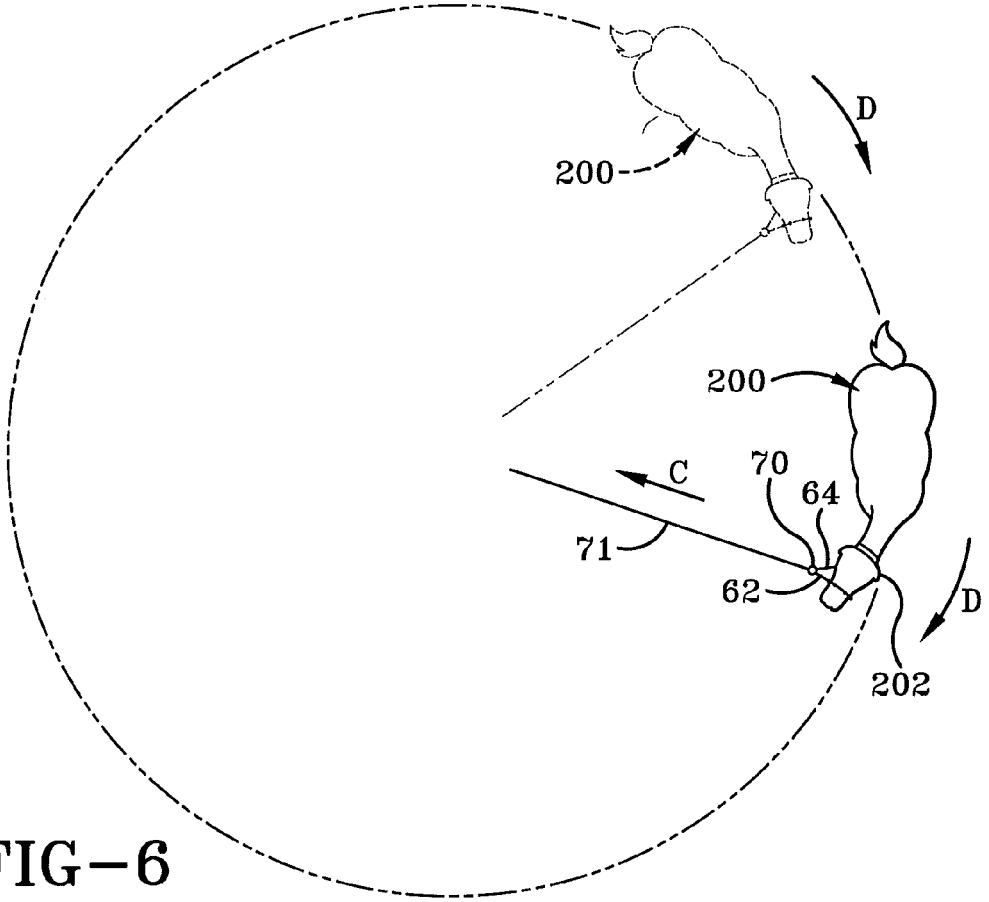
FIG. 6 is a plan view of a sample or exemplary horse training technique utilizing the present invention halter.

In operation as shown in FIG. 6, halter 50 is fitted to a horse 200 and guided along the direction of Arrow D by a trainer via lead line 71 pulled in the direction of Arrow C. The halter 50 applies pressure slowly such that the horse learns to succumb to the pressure and succumb to the trainer's direction. If the horse resists, the pressure increases and become uncomfortable. If the horse succumbs the pressure immediately releases and the horse no longer has any discomfort.

When the horse complies with the handler's command (e.g., the horse walks in the direction signaled by the handler), the tension in lead line 71 is removed, which immediately causes knots 59*a*, 59*b* to reduce pressure on the horse's nose 208 and bridge 204. Hence, the reduction or removal of tension from lead line 71 results in an immediate reduction or removal of the pressure applied to the horse's nose by the knots 59*a*, 59*b*.

Like many animals, horses are capable of learning by conditioning. This process can be guided by providing negative reinforcement and positive reinforcement. The immediate reaction of halter 50 to a reduction of tension on lead line 71 facilitates training a horse to respond properly to control signals from the trainer, rider, or handler. Tightening or engaging knots 59*a*, 59*b* (or knots 65*a*, 65*b*, 77*a*, 77*b*) such that they press against the horse's nose 208 represents negative reinforcement. In order to associate this negative reinforcement with a particular behavior, the timing of the negative reinforcement must be precisely controlled. Halter 50 regulates the discomfort for the horse so that it becomes meaningful negative reinforcement. When the horse is responding properly to control signals, nose rope 58 comfortably on the horse's nose and the horse experiences little or no discomfort. Nose rope 58 causes discomfort to the horse via knots 59*a* and 59*b* contact the bridge 204 of the nose 208 as tension is applied to lead line. Since the discomfort is quickly relieved as tension is removed from the lead line, the horse more readily learns how to properly respond to signals from the handler.

The amount of force that must be applied to lead line 71 to cause the nose rope 58 to apply pressure to the horse's nose can be adjusted to suit the particular horse or handler. For example, when training a horse for the first time, it may be desirable to adjust the halter so that less force is required to apply pressure to the horse's nose. On the other hand, when handling a trained horse, it may be desirable to adjust the halter so that more force is required to apply pressure to the horse's nose.

As used herein the term "web material" refers to a material having a planar portion that lies flat against the horse's skin for comfort. Some exemplary web materials used in the construction of halter 50 include nylon material conventionally used in webbing-type halters for the construction of the poll strap 52 and the cheek straps 56*a*, 56*b*. Alternatively, the web material of the strap portions 52, 56*a*, 56*b* may be constructed from leather. The nose rope 58, throat rope 61, chin rope 62, and lower jaw rope 64 are preferably constructed of a rope material having a circular cross section similar to a conventional rope halter. As used herein the term "rope material" refers to a material having a rounded or convex portion (when viewed in cross-section) contacting the horse's skin 201, imparting more control to the rider or trainer. Some exemplary rope materials include, but are clearly not limited to, yacht rope, lariat rope, mohair, horsehair, jute, cotton, leather or nylon rolled to resemble rope.

Additionally, with reference to components of halter 50, some materials may have suitable alternatives which are fully contemplated. For example, while the poll strap is preferably a web material, or flat leather, or other leathers having at least a flat horse engaging portion, there may be an additional type of material having a flat horse engaging surface. With regards to the cheek straps, while webbing material having a flat horse engaging surface is preferred, the cheek straps may be slightly padded or filled with lining which causes a slight curvature to the horse engaging surface. Padded cheek straps may further be adorned with embroidered designs or other fancy adornments. With regard to the nose rope, chin rope, throat rope, and lower jaw rope, there may be instances where these ropes are made from rolled leathers, braided leathers, braided rawhides, cables, chains, or other materials having a convex horse engaging surface. With respect to the side rings, other shapes are clearly contemplated, such as square, oval, octagon, and other irregular or regular shapes. With regards to snap 60, other additional snaps are clearly contemplated, including but not limited to a panic snap, trigger snap, gaiter clasp, and a bolt snap. Further with regards to buckle 54, while a standard tongue buckle is contemplated, clearly other buckles are entirely possible, including but not limited to a Johnson buckle, a belt loop, and a Conway buckle.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the preferred embodiment of the invention are an example and the invention is not limited to the exact details shown or described.

The invention claimed is:

1. A horse halter comprising:

a first elongated member including a linear horse engaging portion;

a second elongated member including a curved horse engaging portion and having first and second ends, the second elongated member adapted to extend transversely along a nose of a horse;

a forward first connector adapted to be positioned adjacent a left cheek on the horse;

a first knot connecting the first end of the second elongated member to the forward first connector;

a forward second connector adapted to be positioned adjacent a right cheek on the horse;

a second knot connecting the second end of the second elongated member to the forward second connector;

a third elongated member including first and second ends, the third elongated member positioned below the second elongated member and adapted to extend below a chin on the horse;

a third knot connecting the first end of the third elongated member to the forward first connector;

a fourth knot connecting the second end of the third elongated member to the forward second connector; wherein the third elongated member is continuous between the third knot and the fourth knot;

a slide ring slidably receiving the third elongated member therethrough, wherein the slide ring slides entirely along the third elongated member in a continuous manner from the third knot to the fourth knot when the slide ring is pulled by a lead line; and wherein the first and third knots apply pressure to the horse when the slide ring is pulled towards the forward second connector and wherein the second and fourth knots apply pressure to the horse when the slide ring is pulled towards the forward first connector.

2. The halter of claim 1, wherein the first elongated member is generally rectangular in cross section, and wherein a portion of the second elongated member is generally circular in cross section, wherein a portion of the third elongated member is generally circular in cross section, further comprising:

a fifth knot formed from the second elongated member intermediate the first and second knots.

3. The halter of claim 1, further comprising a first flexible cheek member extending between the first member and the second member;

a rear first connector adapted to be positioned adjacent a left jaw portion on the horse;

a rear second connector adapted to be positioned adjacent a right jaw portion on the horse; and wherein the first flexible cheek member is connected to the forward first connector and to the rear first connector.

4. The halter of claim 3, further comprising:

a fourth flexible elongated member having two ends, and positioned beneath the first elongated member, a first end of the fourth member coupled to the rear second connector and a second end of the fourth member coupled to a snap that releasably connects to the rear first connector, and the fourth member including a curved portion in cross section.

5. The halter of claim 4, further comprising:

an elongated jaw member extending between the third member and the fourth member beneath the first flexible cheek member, the elongated jaw member including a forward end fixedly attached to the slide ring, wherein the forward end of the elongated member slides in unison with the slide ring upwardly towards the forward first and second connectors.

6. The halter of claim 3, further comprising:

a second flexible cheek member extending between the first elongated member and the second elongated member, wherein both the first cheek member and the second cheek member include a horse engaging linear portion in cross section;

wherein the first flexible cheek member connects to the forward first connector and to the rear first connector; and wherein the second flexible cheek member connects to the forward second connector and to the rear second connector.

7. The halter of claim 1, further comprising:

a first bulb member positioned along the second elongated member intermediate the first and second knots.

8. The halter of claim 7, further comprising:

a second bulb member positioned on and spaced along the second elongated member adjacent the first bulb member and intermediate the first and second knots.

9. The halter of claim 1, wherein the first elongated member comprises nylon.

10. The halter of claim 1, wherein the first elongated member consists essentially of leather.

11. The halter of claim 1, wherein the second elongated member is a rope material.

12. The halter of claim 1, wherein the third knot is positioned directly below the first knot; and wherein the fourth knot is positioned directly below the second knot.

13. The halter of claim 1, further comprising:

a jaw rope extending rearwardly from a fixed connection with the slide ring.

14. The horse halter of claim 1, wherein the slide ring defines an aperture aligned sagittally coplanar with the horse when no tension is applied to the slide ring.

15. A horse halter comprising:

an elongated flexible poll member including a flat horse engaging portion in cross section;

an elongated flexible nose member including a convex horse engaging portion in cross section;

a first flexible cheek member extending between the poll member and the nose member;

a forward first connector adapted to lay adjacent a left cheek of a horse;

a forward second connector adapted to adjacent a right cheek of the horse; and wherein a first knot connects a first end of the elongated flexible nose member to the forward first connector and a second knot connects a second end of the elongated flexible nose member to the forward second connector;

an elongated chin member including first and second ends, the chin member positioned directly below the nose member and laying beneath a chin on the horse;

a third knot connecting the first end of the chin member to the forward first connector;

a fourth knot connecting the second end of the chin member to the forward second connector; wherein the chin member is continuous as a single piece of material between the third knot and the fourth knot;

a slide ring slidably receiving the chin member therethrough, wherein the slide ring slides entirely along the chin member in a continuous manner from the third knot to the fourth knot when the slide ring is pulled by a lead line;

wherein the first and third knots apply pressure to the horse when the slide ring is pulled upwardly towards the forward second connector and wherein the second and fourth knots apply pressure to the horse when the slide ring is pulled upwardly towards the forward first connector.

16. The horse halter of claim 15, wherein the poll member is a nylon web material.

17. The horse halter of claim 15, wherein the poll member is leather.

18. The horse halter of claim 15, wherein the nose member is a rope, and further comprises a fifth knot and a sixth knot formed from the rope, wherein the fifth and sixth knots are stationary and positioned intermediate the first and second knots.

19. The horse halter of claim 15, wherein the at least one cheek member includes a flat horse engaging portion in cross section.

20. The halter of claim 15, further comprising:

a rear first connector adapted to lay adjacent a left jaw portion of the horse;

a rear second connector adapted to lay adjacent a right jaw portion of the horse;

a snap releasably connected to the rear first connector;

an elongated flexible throat member formed from rope having two ends, a first end connected to the snap and a second end connected to the rear second connector the throat member including a convex portion in cross section.

21. The halter of claim 20, further comprising:

a jaw rope connected to the slide ring at a forward end and forming a loop at a rear end, the loop slidably receiving the elongated flexible throat member therethrough.

22. The halter of claim 21, further comprising at least two spaced apart bulb members intermediate the first and second knots on the nose member.

* * * * *